United States Patent [19]

Reinhall

[11] Patent Number: 5,042,726

[45] Date of Patent: Aug. 27, 1991

[54] APPARATUS AND METHOD FOR CONJOINT ADJUSTMENT OF BOTH THE INNER AND OUTER GRINDING SPACES OF A PULP DEFIBRATING APPARATUS

[75] Inventor: Rolf B. Reinhall, Bellevue, Wash.

[73] Assignee: Sunds Defibrator AB, Stockholm, Sweden

[21] Appl. No.: 434,702

[22] Filed: Nov. 13, 1989

[51] Int. Cl.[5] ..... B02C 7/12

[52] U.S. Cl. ..... 241/28; 241/259.1; 241/261.3; 241/296

[58] Field of Search ..... 241/259.1, 30, 259.2, 241/28, 259.3, 37, 261.2, 296, 261.3, 247, 261.1, 261, 298

[56] References Cited

U.S. PATENT DOCUMENTS 3,815,835 6/1974 Apostol et al. ..... 241/259.1 X 4,283,016 8/1981 Reinhall ..... 241/259.2 X

*Primary Examiner*—Mark Rosenbaum

*Attorney, Agent, or Firm*—Eric Y. Munson; Mark P. Stone

[57] ABSTRACT

A method and apparatus is provided for conjoint or simultaneous adjustment of the gap spaces of the inner and outer grinding zones of a pulp refiner apparatus in a single step. The inner grinding zone is generally radially oriented, and merges into an outer inclined grinding zone. Pulp stock to be ground is introduced into a central inlet position and is accelerated through the inner and outer grinding zones by centrifugal forces generated by a pair of grinding members which rotate relative to one and other. The opposed surfaces of the relatively rotating members each carry a plurality of concentric rows of teeth, and the gap spacing of the inner grinding zone is defined between adjacent surfaces of the teeth. The adjacent teeth defining the inner grinding zone are arranged so that adjustment of the gap space of the outer grinding zone simultaneously controls the gap spacing of the inner grinding zone without the need for separate adjustment. Retarding rings are provided adjacent to the concentric rows of teeth to prevent pulp from by-passing the grinding spaces between adjacent teeth.

20 Claims, 6 Drawing Sheets

FIG. 6
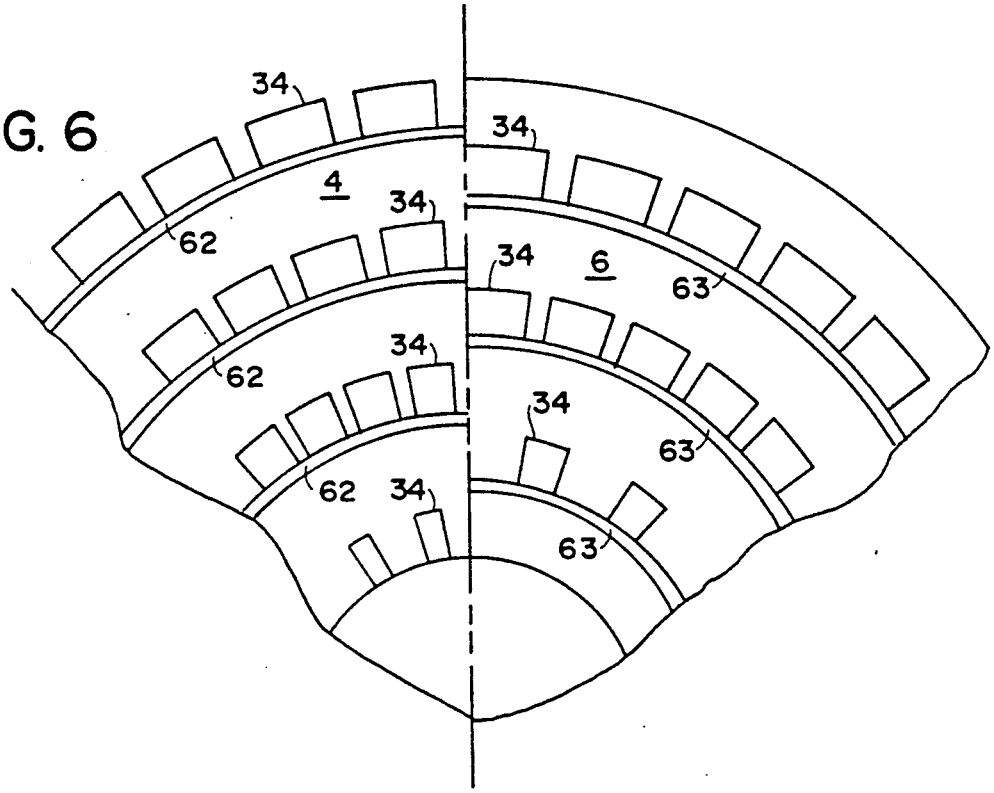
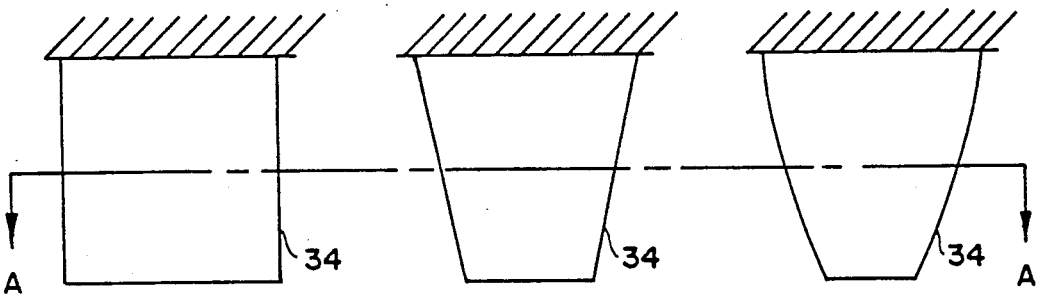
FIG. 7
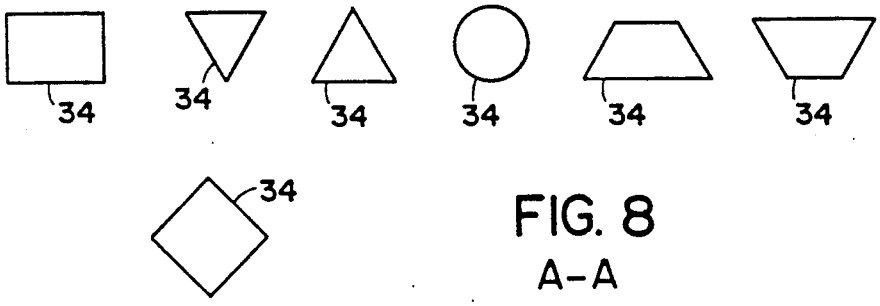
FIG. 8
A-A

APPARATUS AND METHOD FOR CONJOINT ADJUSTMENT OF BOTH THE INNER AND OUTER GRINDING SPACES OF A PULP DEFIBRATING APPARATUS

BACKGROUND OF THE INVENTION

U.S. Pat. No. 4,253,613, issued on Mar. 3, 1981 to the present inventor, discloses a method and apparatus for controlling the effect of centrifugal forces on pulp stock which is ground in a grinding space of a refiner or a defibrating apparatus between a pair of relatively rotatable grinding members. The pulp material which may consist of wood chips, bagasse, pulp fiber or similar fibrous material, is fed by a conveyor such as a screw feeder or the like, through an opening in the central portion of a stationary grinding disc into the center or "eye" of a first radially oriented inner grinding zone defined between the opposed discs. The opposed surfaces of the discs are provided with ridges and grooves which shear the fibers of the pulp or grist in grinding-like fashion. Material introduced into the "eye" of the inner radial grinding space is propelled by the centrifugal force generated by the rotational movement of the discs towards the periphery of the discs.

The apparatus disclosed in U.S. Pat. No. 4,253,613 defines a second outer grinding space which merges with the outer or peripheral end of the inner radial grinding zone. The outer grinding zone is oriented at an inclined angle relative to the inner radial grinding zone and defines a cylindrical or drum shaped grinding zone. The inner and outer grinding zones define a continuous grinding space through which pulp material introduced into the "eye" of the inner grinding space is propelled outwardly by centrifugal forces generated by the relatively rotating discs and advances through both the inner radial grinding zone and the outer inclined grinding zone. The pulp material is ejected and discharged from the open remote end of the outer inclined grinding zone into suitable discharge means. The advantages of the method and apparatus disclosed in U.S. Pat. No. 4,253,613, as more fully discussed in the patent itself, include the arrangement of the inner and outer grinding zones to efficiently control the effect of centrifugal force on the pulp stock advancing through the grinding space to increase dwell time of the pulp for enhancing the efficiency of the overall refining operation. Other advantages of the method and apparatus of U.S. Pat. No. 4,253,613 are apparent from the patent, and the disclosure of the patent is expressly incorporated by reference herein.

One disadvantage of the method and apparatus disclosed in the aforementioned patent is that adjustment of the width or gap of the inner radial grinding zone must be made separately and independently of any adjustment to the width or gap of the outer inclined grinding zone. As discussed and illustrated in the patent, the gap spacing of the inner grinding zone can be conventionally adjusted by means of an adjusting mechanism of the type more fully disclosed in U.S. Pat. No. 3,827,644. However, adjustment of the outer inclined grinding zone is made independent from the adjustment to the inner grinding zone by employing a ring member which is slideably seated in a cylindrical annular recess and actuated by a plurality of pistons connected to the ring member by means of piston rods. Simultaneous adjustment of the gap space of the inner and outer grinding zones is not possible in the prior art apparatus because adjustment of the spacing of the outer grinding zone will not result in a corresponding adjustment of the spacing of the inner grinding zone, and vice versa, as a result of the angular orientation between the inner and outer grinding zones. The need to separately and independently adjust the gap spacings of the inner and outer grinding zones is disadvantageous insofar as it requires additional control equipment and control instruments provided on the apparatus, increases the time and labor needed to adjust the grinding space, and results in greater overall costs for grinding operation.

A refiner similar to the apparatus disclosed in U.S. Pat. No. 4,253,613 is disclosed in U.S. Pat. No. 4,283,016, also issued to the present inventor. Additional background methods and apparatus for adjusting the grinding space of pulp refiners are illustrated by the following U.S. patents: U.S. Pat. Nos. 2,971,704; 3,212,721; 3,323,731; 3,295,774; 3,684,200; 3,717,308; 3,754,714; 3,790,092; 3,799,456; 3,827,644; 3,910,511; 3,974,971; 4,039,154; 4,073,442; 4,083,503; 4,269,362; 4,378,092; 4,454,991; 4,529,137; 4,614,304; and 4,627,578. None of these background references illustrated a refiner having an inner radial grinding zone and an outer inclined conical grinding zone in which both grinding zones are capable of simultaneous adjustment in a single step.

U.S. Pat. No. 4,269,362 discloses a disc refiner having only an inner radial grinding zone. The grinding elements are carried on the opposed grinding surfaces and consists of interfitting teeth defined in concentric circles. The spaces between adjacent teeth sucessively decrease toward the peripheral region of the radial grinding zone to provide a kneading or pulsating effect on the pulp propelled outwardly through the grinding zone. Means are provided to adjust the spacing between the adjacent teeth. The disclosure of this patent illustrates the use of opposed teeth only as grinding elements in a known disc refiner. This prior art patent does not recognize applicant's present invention because the teeth are not employed in any manner for simultaneously adjusting the gap spacings of two different grinding zones in a single step, the primary object of the present invention as is discussed herein.

OBJECTS OF THE INVENTION

A principal object of the present invention is to provide a method and apparatus for refining pulp stock in a grinding apparatus having a first inner grinding zone which merges with a second outer inclined grinding zone in which the gap spacings of the respective grinding zones are simultaneously or conjointly adjustable in a single step. A further object of the invention is to provide a refiner apparatus of the aforementioned type which overcomes the so-called infeed "needle-eye" effect of lower peripheral speed and centrifugal forces at the inlet opening of the inner grinding space which restricts the outward flow of material therefrom. A still further object of the invention it to provide a refiner apparatus in which the direction of rotation of the relatively rotatable discs defining the grinding space is reversible. A still further object of the invention is to provide a refiner apparatus of the aforementioned type which is more energy efficient than the known devices as a result of reduction of frictional forces generated in the inner grinding zone. Other objects and advantages of the method and apparatus of the present invention will become apparent from the following description.

SUMMARY OF THE INVENTION

The present invention provides a method and apparatus for simultaneous or conjoint adjustment of the gap spacings of a pulp refiner apparatus having a first inner grinding zone and a second inclined outer grinding zone merging with the first zone. The inner grinding zone is defined between opposed surfaces of relatively rotatable grinding members. Each of the opposed surfaces carries a plurality of concentric rows of teeth extending toward the other surface and oriented such that a row teeth extending from one surface is disposed between a pair of rows of teeth extending from the other surface. In this manner, the inner grinding space is defined by a plurality of grinding spaces between opposed surfaces of adjacent, radially offset, rows of teeth. Preferably, each concentric row of teeth will be provided with retarding means to prevent pulp stock from by-passing the spaces between adjacent teeth. The gap spacing and angular orientation between adjacent pairs of opposed teeth may be set to correspond to the gap spacing and annular orientation of the inclined outer grinding zone so that adjustment of the gap space of the outer grinding zone automatically adjusts each of the plurality of gap spaces between adjacent teeth of the inner zone the same distance. In the alternative, the plurality of teeth extending from the opposed grinding discs may be oriented so that the gap spacing between adjacent teeth remains constant and independent of any adjustment of the gap spacing of the outer inclined grinding zone. As a further alternative, the opposed teeth may be configured and oriented so that only some but not all of the plurality of gap spaces between adjacent teeth are automatically adjustable together with adjustment of the gap spacing of the outer grinding zone. Additionally, the teeth may be oriented and arranged so that the plurality of gap spaces defined therebetween are automatically adjustable together with the outer grinding zone, but the spacings between the teeth are adjusted a different distance than the gap space of the outer zone. In all embodiments of the invention, the gap space of the outer inclined grinding zone is adjustable without the need to separately and independently adjust the gap space of the inner grinding zone.

BRIEF DESCRIPTION OF THE DRAWINGS

FIG. 6 is a schematic elevational view of the inner grinding zone of the refiner of FIG. 1 illustrating concentric rows of teeth carried by opposed rotatable and stationary grinding members, and circular retarding rings provided between the rows of teeth;

FIG. 7 illustrates examples of different configurations of teeth defining the inner grinding zone viewed in a radial direction; and FIG. 8 illustrates examples of cross sections of different teeth defining the inner grinding zone viewed in an axial direction.

DISCUSSION OF THE BEST MODES FOR CARRYING OUT THE INVENTION

Figure 1:
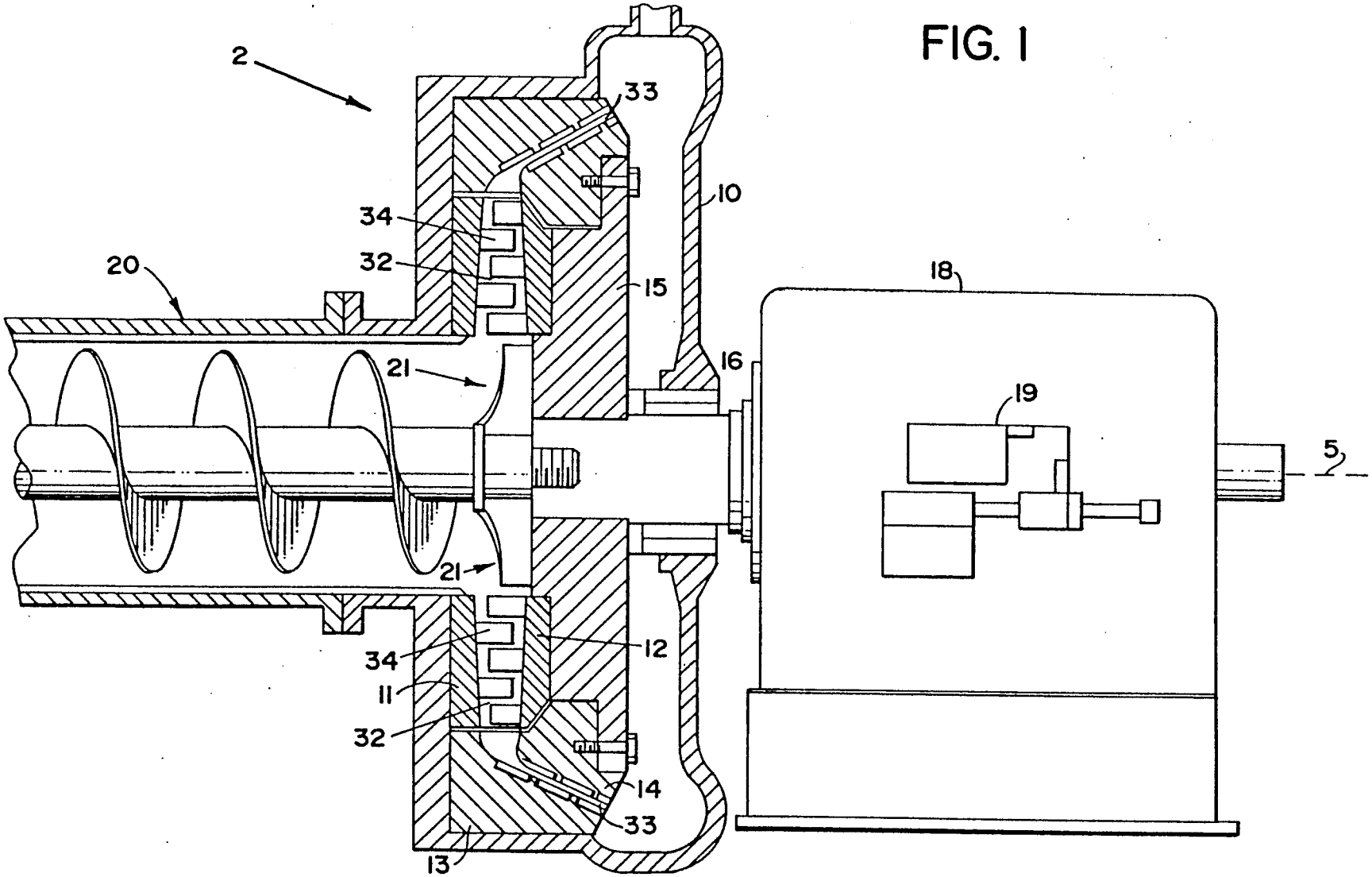
FIG. 1 of the drawings illustrates a vertical section through one type of refiner apparatus in accordance with the present invention.

FIG. 1 of the drawing illustrates a vertical section through a portion of a refiner apparatus generally similar to the refiner disclosed in U.S. Pat. No. 4,253,613, the disclosure of which is expressly incorporated herein by reference. The refiner of FIG. 1 is generally designated by the reference numeral 2 and includes a casing housing 10 and a rotary holder 15 mounted within the housing 10. Rotary grinding members 12 and 14 which are carried on the rotary holder 15 and are oriented to oppose stationary grinding members 11 and 13, respectively. A primer inner generally radial grinding space 32 is defined between the rotary grinding member 12 and the opposed stationary grinding member 11, and an outer inclined secondary grinding space 33 is defined between the rotary grinding member 14 and the opposed stationary grinding member 13. The inclined outer grinding space 33 defines a generally conical grinding zone, which extends from and merges with the peripheral end of the inner radial grinding space 32 to define a continuous passageway through the grinding spaces 32 and 33.

The opposed surfaces of the rotary grinding member 14 and the stationary grinding member 13 defining the inclined space 33 are equipped with conventional grinding segments such as grooves and ridges as is well known to the art and exemplified by the aforementioned U.S. Pat. No. 4,253,613. The opposed surfaces of the rotary grinding member 12 and the stationary grinding member 11, which define the inner radial grinding space 32, are each equipped with radially offset concentric rows of opposed meshing teeth 34, as will be more fully explained below.

The rotary holder 15 and thus the rotary grinding members 12 and 14, are mounted on a shaft 16 which is journalled in a frame 18 of the refiner 2 in a conventional manner. The housing 18 of the refiner also includes a servo-motor mechanism designated generally by reference numeral 19, for providing rotational energy for the shaft 16 for rotating the rotary grinding members around an axis of rotation 5. The inner grinding zone 35 is oriented along a plane which is substantially perpendicular to the axis of rotation 5, and the other grinding zone 33 is oriented along an inclined plane at an angle between 0° and less than 90° relative to the axis of rotation 5. A conventional screw feeder 20 is provided to feed raw material to be processed by the refiner into a central opening in a stationary disc carrying the stationary grinding members 11 and 13. Material fed into this opening is introduced into the inlet region 21 of the inner radial grinding space 32, and accelerated outwardly by the centrifugal force generated by the relatively rotating grinding members. The pulp or raw material is refined as it is propelled through both the inner, generally radial grinding zone 32 and the outer inclined grinding zone 33, until it is discharged from the outer end of the outer grinding zone into suitable collecting means (not shown in drawing) provided at the discharge outlet end.

What has been described up until now, except for the provision of the teeth 34 in the inner radial grinding zone 32, is conventional and more fully explained in U.S. Pat. No. 4,253,613. Although the preferred embodiment of the invention employs a refiner including a stationary grinding member and an opposed rotatable grinding member as illustrated by FIG. 1, it is also possible to employ two opposed rotatable members which each rotate in different directions, or two opposed rotatable members rotating in the same direction at different rotational speeds. It is only necessary that the refiner provide relative rotation between two opposed grinding members. Moreover, although the stationary and rotatable grinding members are shown in FIG. 1 as being carried on stationary and rotatable opposed discs, the grinding members may also be carried on supporting bodies other than discs, such as drums or cylinders.

As also discussed in U.S. Pat. No. 4,253,613, the width or gap space of both the inner and outer grinding zones 32 and 33 must be precisely defined and maintained to provide efficient refining and to avoid damage to the opposed grinding members. Adjustment of the respective gap spacings of the inner and outer grinding zones 32 and 33 in the general type of refiner illustrated by FIG. 1 of the drawing, prior to the present invention, requires independent adjustment of the gap spaces of each grinding zone in different steps. Separate adjustment of the respective grinding spaces is necessary because adjustment of the gap spacing of the outer angular grinding zone will not result in a corresponding adjustment of the gap space of the inner grinding zone, but will result in over-adjustment or under-adjustment due to the angular inclination of the outer grinding zone. Likewise, an adjustment of the gap spacing of the inner grinding zone will either over-adjust or under-adjust the gap spacing of the outer inclined grinding zone. Therefore, adjustment of the respective grinding zones has been done in separate and independent steps.

As will be discussed in further detail below, the refiner disclosed by FIG. 1 of the drawings enables adjustment of the gap spacings of both the outer grinding zone 33 and the inner grinding zone 32 to be made simultaneously in a single step. In acordance with the present invention, the gap spacings of both grinding zones can be simultaneously adjusted by an identical distance, by a corresponding but not identical distance, or the gap space of the outer zone may be adjusted without any change made to the gap space of the inner grinding zone. Precise adjustment of the gap space of the outer grinding zone in the apparatus illustrated by FIG. 1 of the drawing is necessary for quality control of the pulp being processed by the refiner. The present invention simplifies the procedure for making the necessary adjustments to the gap spacing of the outer grinding zone.

Figure 2:
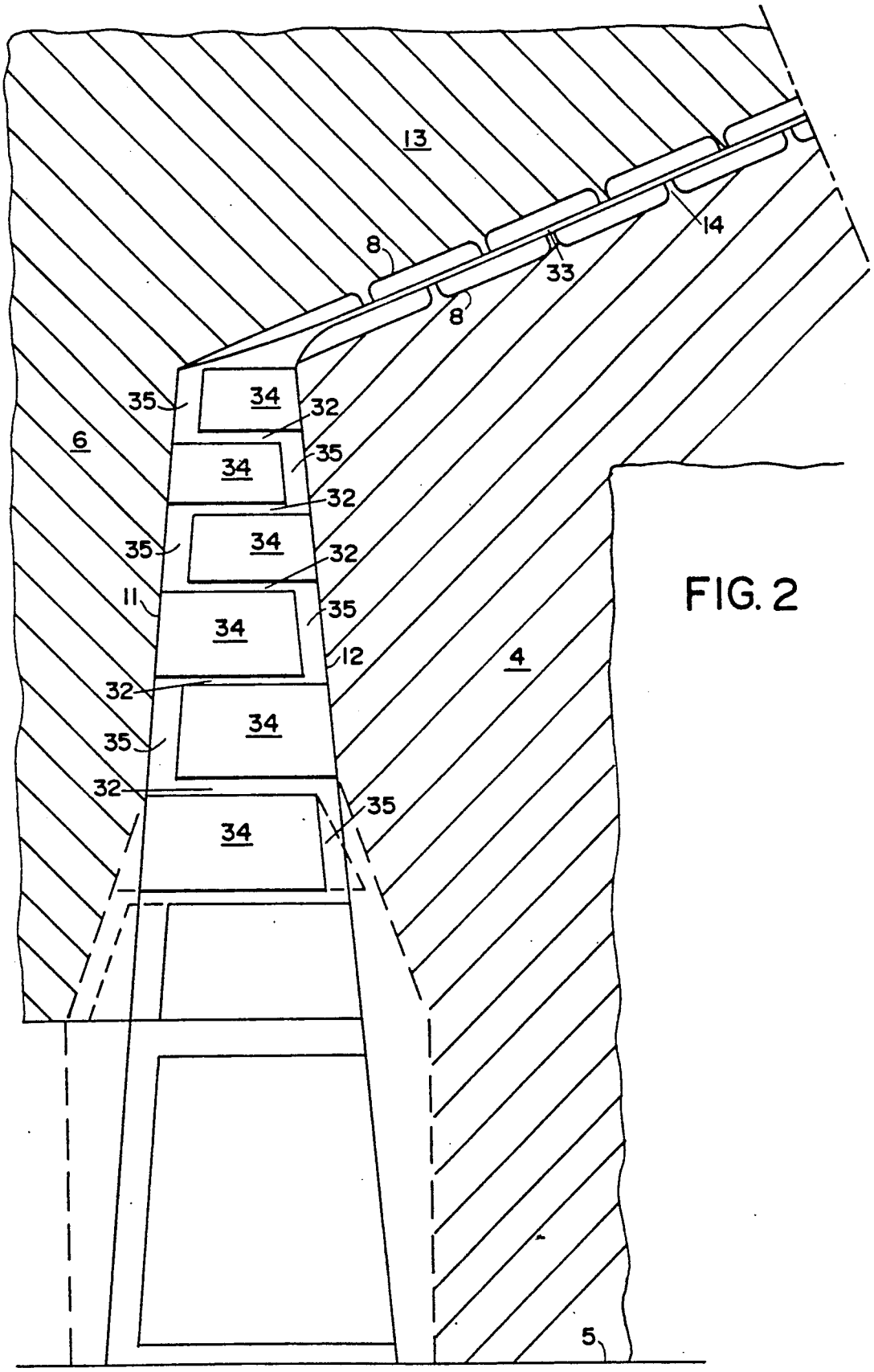
FIG. 2 is a schematic cross section of the grinding space defined by an inner radial grinding zone merging with an outer inclined grinding zone defined between two relatively rotatable grinding members in accordance with one embodiment of the present invention.

FIG. 2 of the drawing illustrates a cross sectional view of the grinding zones 32 and 33 of the refiner 2 of FIG. 1. A portion of a rotatable supporting member (e.g., a rotatable disc) is designated by the reference numeral 4, while a portion of an opposed stationary supporting member (e.g., a stationary disc) is designate by the reference numeral 6. The rotatable support 4 carries an inner rotatable grinding member 12 and an outer rotatable grinding member 14, while the opposed stationary support 6 carries an inner stationary grinding member 11 and an outer stationary grinding member 13. The opposed facing surfaces of the outer grinding members 13 and 14 carry conventional grinding segments such as grooves and ridges designated by the reference numeral 8, and the outer inclined grinding space 33 is defined therebetween. The inner portions of the opposed supporting members 4 and 6 carry opposed grinding surfaces 12 and 11 which define the inner grinding zone 32. Each surface 11 and 12 is provided with a plurality of teeth 34 extending toward the opposed grinding surface. As more clearly shown in FIG. 6, the teeth 34 provided on each of the opposed grinding surfaces 11 and 12 are arranged in rows of concentric circles, and each of the concentric rows on one surface are radially offset from adjacent concentric rows on the other surface to provide spaces 32 defined between adjacent working surfaces of the teeth 34.

As illustrated in FIG. 2, the spaces 32 defined between the adjacent teeth 34 extending from the opposed surfaces 11 and 12 define the overall inner radial grinding space of the refiner apparatus. The teeth 34 are shorter in length than the distance between the opposed surfaces 11 and 12 to provide a space or clearance 35 between the free end of each tooth and the opposed surface. As will become apparent below, the space 35 is defined to permit maximum axial adjustment of the outer conical grinding zone 32 without any corresponding change in the axial position of the stationary supporting member 6. Relative axial movement between members 4 and 6 along the axis of rotation 5 will result in an adjustment of the gap space or width of the inclined grinding zone 33 but will not affect the gap spaces 32 defined between adjacent teeth 34 in the inner radial grinding zone. This occurs because the spaces 32 are oriented along a plane parallel to the axis of rotation 5 and are thereby unaffected by relative movement in the axial direction.

Figure 3:
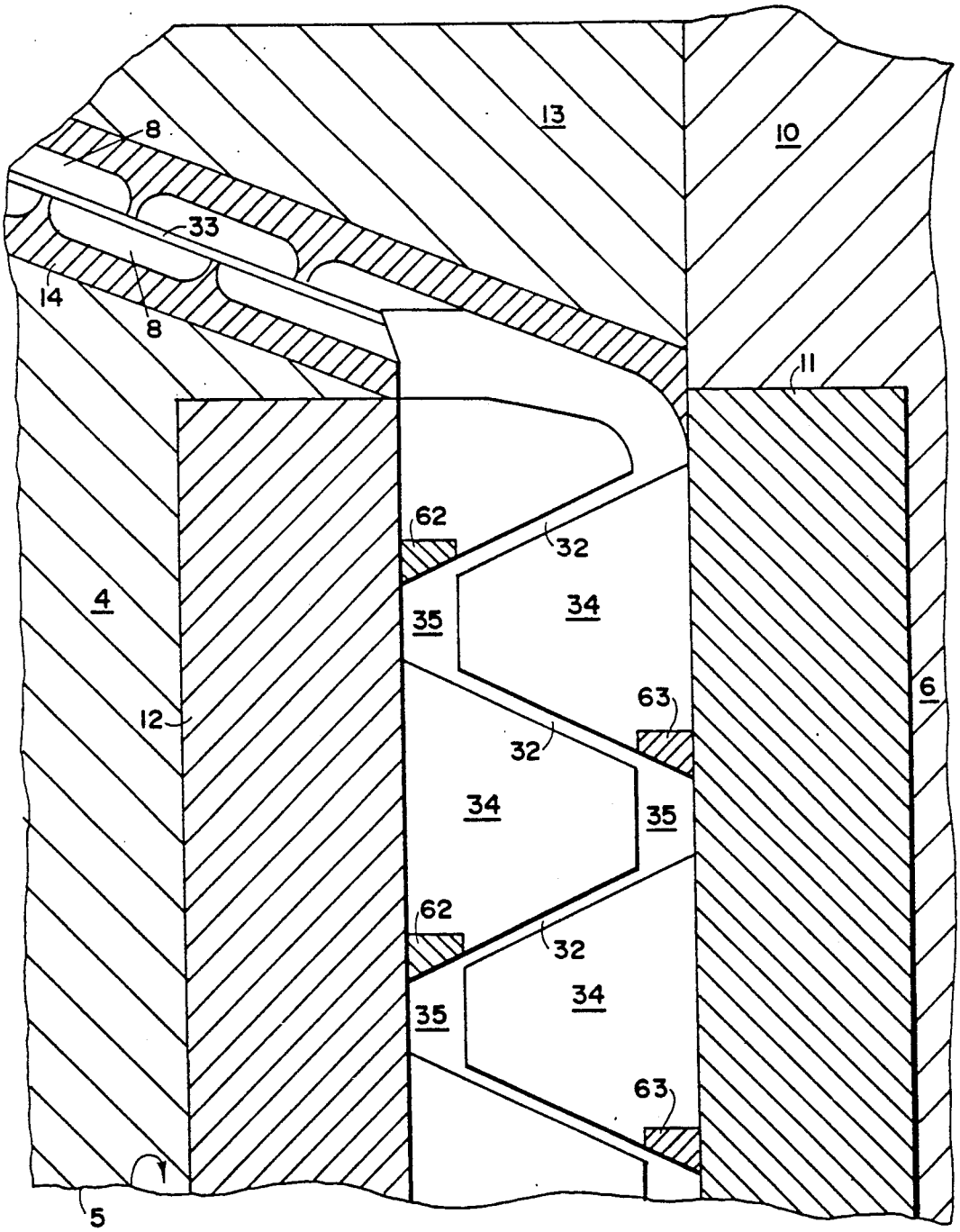
FIG. 3 is a cross section of the grinding space of a refiner apparatus in accordance with a further embodiment of the present invention in which adjacent teeth extending into the inner grinding zone are oriented at an angle corresponding to the angular orientation of the outer inclined grinding zone.

FIG. 3 is similar to FIG. 2, and corresponding reference numerals have been used to designate the same elements. The teeth 34 extending from the opposed grinding members 4 and 6 are generally conical in shape, and the gap spaces 32 defined between opposed surfaces of adjacent teeth 34 are angularly oriented. In the embodiment disclosed by FIG. 3, the angular orientation of the gap spaces 32 defined between adjacent teeth 34 relative to the axis of rotation 5 corresponds indentically to the angular orientation of the gap space 33 of the outer inclined grinding zone relative to the axis of rotation 5. As a result of the correspondence between the angular orientation of gap spaces 32 and 33, relative axial movement of the members 4 and 6 along the axis of rotation 5 will simultaneously adjust the gap spacing of the inner and outer grinding zones 32 and 33 an indentical corresponding distance. If the gap spacing 32 between the teeth 34 of the inner grinding zone is initially equivalent to the gap spacing 33 of the outer grinding zone, the adjusted gap spaces will be maintained identical to each other. It is also apparent that the angular orientation of the gap spaces 32 may be varied from that of the angular orientation of the outer may be grinding zone 33 so that relative axial movement of the stationary and rotatable members 6 and 4 results in simultaneous adjustment of all gap spaces 32 to a width different from the adjusted width of the outer grinding zone. Additionally, the two working surfaces of each tooth 34 may each be oriented at different angles relative to each other so that the spaces 32 between the teeth are automatically adjusted to different distances simultaneously with the adjustment of the gap space 33 of the outer grinding zone.

As discussed with respect to FIG. 2, the teeth 34 of the FIG. 3 embodiment are arranged on the opposed inner surfaces of members 4 and 6 in concentric circles which are radially offset from each other so that a desired initial gap space 32 is defined between the opposed surfaces of teeth in adjacent rows (See FIG. 6). The invention also provides retarding means, as for example, circular retarding rings 62 and 63 mounted respectively along the concentric rows of teeth carried by each of the opposed grinding members 4 and 6, as illustrated in FIG. 3. Although the retarding rings 62 and 63 are shown as a quadrangle in cross section in the drawing figures, any other sectional configuration (e.g. triangular) may be employed as long as the retarding means provide a retarding surface for the purpose to now be discussed. The retarding rings, as best shown in FIG. 6 of the drawing, prevent pulp material being processed by the refiner in the inner grinding zone from bypassing the gaps 32 between adjacent teeth by preventing the pulp from passing through the open spaces 35 between the ends of the teeth and the opposed grinding surface as the pulp is propelled radially outwardly through the inner radial grinding zone. The retarding rings assure that the pulp must pass through the gaps 32 defined between inner concentric rows of adjacent teeth before entering the next successive outwardly oriented row of gaps 32 defined between the next outward pair of adjacent concentric rows of teeth.

Figure 4:
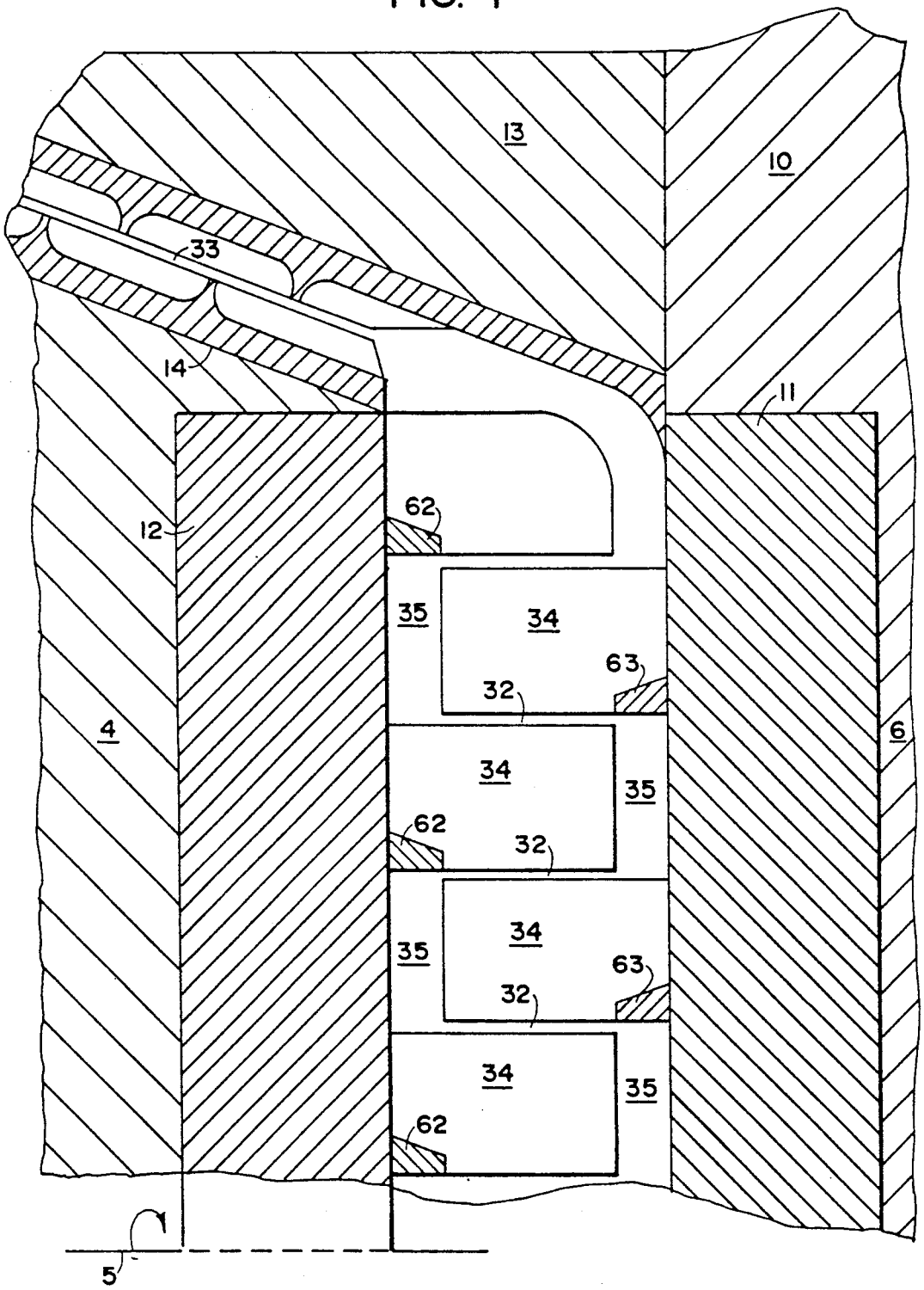
FIG. 4 is a further embodiment of the invention which is similar to FIG. 3 except that the teeth defining the inner grinding zone are oriented at an angle substantially parallel to the axis of rotation of the refiner apparatus.

FIG. 4 of the drawing is similar to the FIG. 3 embodiment, and the same reference numerals have been used to designate corresponding elements. In the FIG. 4 embodiment of the invention, the teeth 34 are rectangular in cross section, and the gap 32 defined between opposed surfaces of adjacent teeth is oriented parallel to the axis of rotation 5. As a result, relative axial movement between the rotatable and stationary grinding members 4 and 6 will result in adjustment of the gap space 33 of the inclined outer grinding zone, but will have no effect on the gap spaces 32 of the inner radial grinding zone which will be maintained constant at its initial width. This embodiment permits adjustment of the outer grinding zone without any regard to the inner grinding zone.

Figure 5:
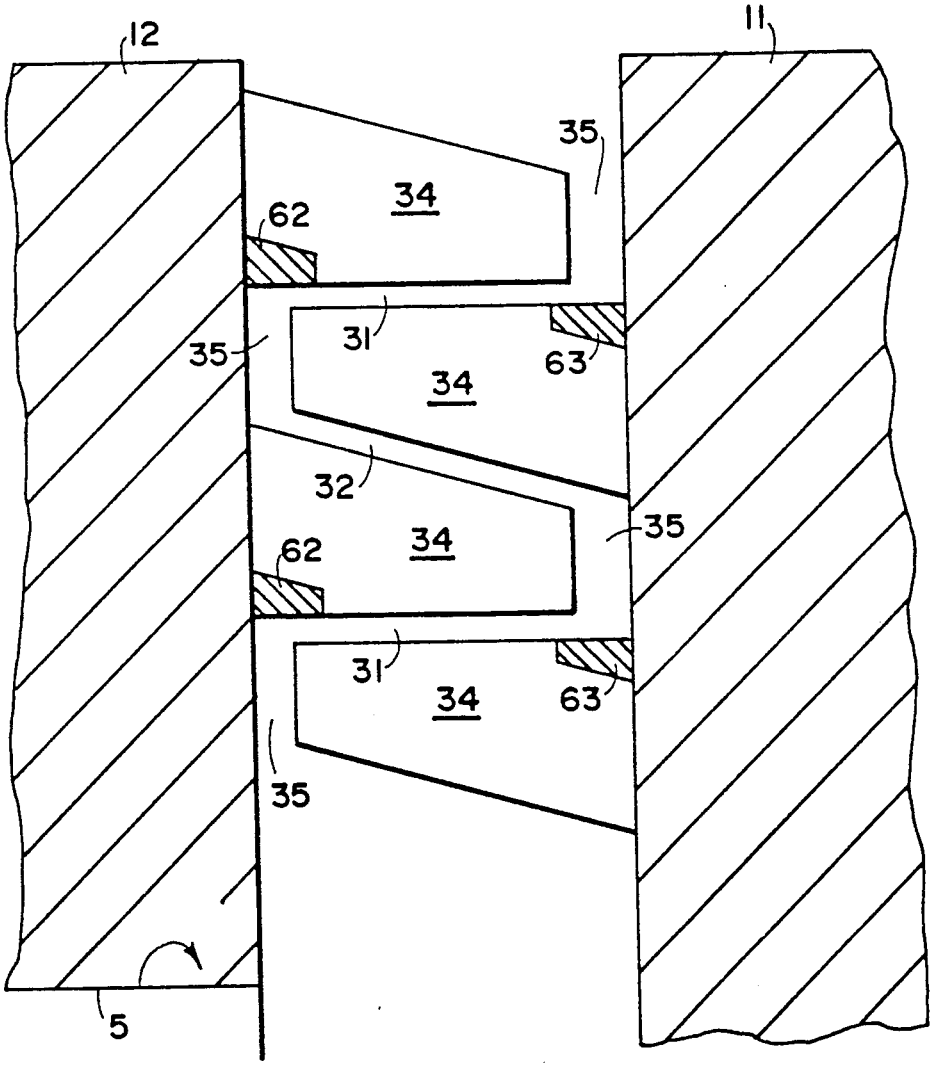
FIG. 5 is a further embodiment of the invention which is similar to FIG. 3 except that the teeth extending into the inner grinding zone are configured so that one side of each tooth is oriented substantially parallel to the axis of rotation of the refiner apparatus while the other side of each tooth is oriented at an angle corresponding to the angular orientation of the inclined outer grinding zone.

The embodiment illustrated by FIG. 5 of the drawing is also similar to the embodiments illustrated by FIGS. 3 and 4. However, in the FIG. 5 embodiment, the teeth 34 of the inner radial grinding zone are configured so that one surface of each tooth 34 is parallel to the axis of rotation 5, while another surface of each tooth 34 is oriented at an angle relative to the axis of rotation 5. In this manner, the spaces defined between opposed surfaces of adjacent teeth are successively parallel and angularly oriented relative to the axis of rotation. Relative axial movement between the rotatable and stationary grinding members 4 and 6 will simultaneously adjust the width of the inclined spaces 32, but will have no effect on the width of the parallel gap spaces 31. Therefore, adjustment of the width of the outer inclined grinding space 33 by relative axial movement between the rotatable and stationary grinding members will simultaneously adjust the widths of only some, but not all, of the grinding spaces of the inner radial grinding zone defined between the teeth 34. If the angular orientation of the inclined grinding spaces 32 corresponds to the angular orientation of the outer grinding zone 33, the gap spaces 32 and 33 will be automatically and simultaneously adjusted the same distance. If the angular orientation is different, the degree of adjustment made to the respective grinding spaces will be reflected by the difference in angular orientation.

FIG. 6 of the drawing shows an elevational sectional view of the portions of the stationary and rotatable grinding members or discs 4 and 6 defining the inner radial grinding zone 32. Concentric rows of teeth 34 extend from each the surface of each grinding disc in a direction toward the opposed grinding disc. The concentric rows of teeth extending from the respective grinding discs are radially offset from each other so that the gap spaces 32 (FIGS. 2–5) are defined between opposed surfaces of the teeth 34 extending from adjacent rows. A retarding ring 62 is provided on each concentric row of teeth carried by the rotatable disc 4, and a retarding ring 63 is provided on each concentric row of teeth carried by the stationary disc 6. The retarding rings 62 and 63 prevent pulp from passing through the open spaces 35 between the free ends of the teeth and the opposed grinding disc (FIGS. 2–5), thereby assuring that the pulp will pass through the gap spaces 32 defined between the opposed surfaces of adjacent teeth extending from the adjacent concentric rows. Preferably, the gap spaces 32 defined between opposed surfaces of the teeth 34 extending from adjacent concentric rows are uniform in width (not tapered either inwardly or outwardly) to initially break the pulp stock down to a size substantially equal to the gap spaces. The gap spacings defined by the adjacent concentric rows of teeth may be successively decreased in width in a radially outward direction in order to progressively reduce the size of the pulp stock as it is propelled outwardly through the inner grinding zone towards the outer grinding zone. Although the spacing between different pairs of adjacent concentric rows of teeth will preferably be uniform, this spacing may also be varied if desired.

FIG. 7 of the drawing illustrates a radial view of different examples of different configurations of the teeth 34 which may be employed in the present invention, and FIG. 8 of the drawing illustrates an axial view of the cross sections of different configurations of teeth which may be employed in the present invention.

As discussed herein, the method and apparatus of the present invention enables simultaneous adjustment of both the inner and outer grinding zones of a refiner in a single step, and advantageously avoids the need for separate adjustment of each grinding zone. The elimination of the need for separate adjustment of the grinding zones results in reduction of control equipment and control instrumentation, and reduction in time and labor, which would otherwise be required for separate adjustment steps and operations. The method and apparatus of the present inventions is also more energy efficient than the methods and apparatus heretofore known to the prior art. The energy efficiency results in large part through the reduction in axial forces and generation of friction in the inner grinding zone which is provided with spaced adjacent teeth and thereby eliminating the frictional forces from the flat surfaces of an ordinary flat, radial grinding disc with ridges and grooves that are rotating under great axial forces against each other.

As noted above, the width of the space defined between opposed surfaces of adjacent teeth in the inner grinding zone is uniform, with the same taper in any one direction of rotation of the grinding members. This orientation enables the refiner to be operated in either a forward or reverse direction of relative rotation without decreasing the overall efficiency of the refining operation.

The method and apparatus of the present invention also advantageously reduces the so-called infeed "needle-eye" effect of lower peripheral speed and centrifugal forces at the inlet opening position (where the pulp stock is initially introduced into the inner grinding zone), which restricts the outward flow of the pulp. Since the vast majority of the refining operation of the present method and apparatus occurs in the outer primary grinding zone, and not the inlet part of the grinding zone, a relatively wide inlet opening for the pulp material may be provided in the inlet grinding zone, thereby increasing the inlet area and decreasing the adverse "needle-eye" effect.

The present invention has been illustrated with respect to a combined disc-drum type refiner in which the inner grinding zone is defined along a plane substantially perpendicular to the axis of rotation of the grinding members. However, the present invention is equally applicable to other types of refiners in which an inner grinding zone merges with an outer inclined grinding zone. For example, the invention may be employed in a conical disc refiner of the type in which the inner grinding zone is oriented on a plane substantially parallel to the axis of rotation of the drum. The gap spacing of both the inner and outer grinding zones in this type of refiner may be simultaneously adjusted by relative linear movement between the rotor and its housing drum along a plane substantially perpendicular to the axis of rotation of the rotor.

Other advantages and modifications of the invention of the present method and apparatus will become apparent to those skilled in the art. Accordingly, the description of the invention provided herein has been intended to be illustrative only, but not restrictive of the scope of the invention, that scope being defined by the following claims and all equivalents thereto.

I claim:

1. In a refiner apparatus for refining pulp stock, said apparatus including a pair of opposed grinding members relatively rotatable to one another around an axis of rotation, said opposed grinding members defining a first inner grinding zone having a gap space defined by the distance between said opposed grinding members in the region proximate to said first grinding zone, said opposed grinding members further defining a second outer grinding zone having a gap spacing defined by the distance between said opposed grinding members in the region proximate to said second grinding zone, said first grinding zone merging with said second grinding zone which is oriented at an inclined angle relative to said first grinding zone, said first and second grinding zones providing a continuous passageway for pulp stock propelled therethrough by centrifugal forces generated by said relatively rotatable grinding members, and means for introducing said pulp stock into said first grinding zone, the improvement comprising:

means for simultaneously adjusting the gap spacings of said first and second grinding zones, said means for adjusting including a plurality of teeth extending from each of said opposed grinding members into said first grinding zone for defining a plurality of spaces between opposed surfaces of adjacent teeth through which said pulp stock passes, said teeth being configured and oriented to control the width of said spaces between said opposed surfaces of said adjacent teeth during relative linear movement between said opposed grinding members for adjusting the gap spacing of said second grinding zone.

2. The refiner as claimed in claim 1 wherein said opposed surfaces of at least some of said adjacent teeth are oriented at a predetermined angle relative to said axis of rotation, and said teeth are arranged such that said space defined between said angularly oriented opposed surfaces is oriented at said predetermined angle.

3. The refiner as claimed in claim 2 wherein all opposed surfaces of said plurality of teeth are oriented at said predetermined angle, and said teeth are arranged such that all of said spaces between said opposed surfaces of said adjacent teeth are oriented at said predetermined angle.

4. The refiner as claimed in claim 3 wherein said predetermined angle is equal to the inclined angle of said outer grinding zone, and the minimum width of said spaces defined between said opposed surfaces of said adjacent teeth is equal to the gap spacing of said second grinding zone, wherein adjustment of the gap spacing of said second grinding zone results in an identical adjustment to said spaces defined between said opposed surfaces of said plurality of teeth.

5. The refiner as claimed in claim 1 wherein one of said surfaces of each of said plurality of teeth is oriented at a first predetermined angle relative to said axis of rotation, and another of said surfaces of each of said plurality of teeth is oriented at a second predetermined angle relative to said axis of rotation different from said first predetermined angle, said plurality of teeth being arranged such that the spaces defined between opposed surfaces of adjacent teeth are oriented at different angles relative to said axis of rotation.

6. The refiner as claimed in claim 1 wherein at least one of said opposed surfaces of said adjacent teeth is oriented relative to said axis of rotation such that at least some of the spaces defined between said opposed surfaces of said adjacent teeth are maintained at a constant value during said adjustment of said gap spacing of said second grinding zone.

7. The refiner as claimed in claim 6 wherein another surface of each of said plurality of teeth is oriented at an angle relative to said axis of rotation, and said teeth are arranged such that some of the spaces therebetween are simultaneously adjusted together with adjustment of the gap spacing of said outer grinding zone, and other of the spaces therebetween remain constant during adjustment of the gap spacing of said outer grinding zone.

8. The refiner as claimed in claim 6 wherein all opposed surfaces of each of said plurality of teeth are oriented relative to said axis of rotation such that all of said spaces defined between all of said opposed surfaces of adjacent teeth remain constant during said adjustment of the gap spacing of said outer grinding zone.

9. The refiner as claimed in claim 1 wherein said plurality of teeth are mounted to each of said grinding members in concentric circular rows, said concentric circular rows on one of said grinding members being radially offset from said concentric rows on said opposed grinding member for defining said plurality of spaces between adjacent concentric rows of teeth.

10. The refiner as claimed in claim 9 including retarding means provided on each of said concentric rows of teeth on each of said grinding members for preventing said pulp stock from bypassing said plurality of spaces defined between said adjacent concentric rows of teeth.

11. The refiner as claimed in claim 9 wherein said concentric rows of teeth are arranged such that the widths of said spaces defined between opposed surfaces of teeth in adjacent concentric rows decreases successively in outwardly oriented adjacent concentric rows such that the size of said pulp stock is successively reduced as the pulp stock passes outwardly through said inner grinding zone.

12. The refiner as claimed in claim 1 wherein each of the spaces defined between said opposed surfaces of said adjacent teeth is constant in width.

13. The refiner as claimed in claim 11 including retarding means provided on each of said concentric rows of teeth on each of said grinding members for preventing said pulp stock from bypassing said spaces defined between said opposed surfaces of adjacent teeth.

14. In a refiner apparatus for refining pulp stock, said apparatus including a pair of opposed grinding members relatively rotatable to one another along an axis of rotation, said opposed grinding members defining a first inner grinding zone having a gap space defined by the distance between said opposed grinding members in the region proximate to said first grinding zone, said opposed grinding members further defining a second outer grinding zone having a gap spacing defined by the distance between said opposed grinding members in the region proximate to said second grinding zone, said first grinding zone merging with said second grinding zone which is oriented at an inclined angle relative to said first grinding zone, said first and second grinding zones providing a continuous passageway for pulp stock propelled therethrough by centrifugal forces generated by said relatively rotatable grinding members, and means for introducing said pulp stock into said first grinding zone, the improvement comprising:

means for simultaneously adjusting the gap spacings of said first and second grinding zones, said means for adjusting including a plurality of teeth extending from each of said opposed grinding members into said first grinding zone for defining a plurality of spaces between opposed surfaces of adjacent teeth through which said pulp stock passes, said plurality of teeth being mounted to each of said grinding members in concentric rows, said concentric rows of teeth extending from one of said grinding members being radially offset from said concentric rows extending from said opposed grinding member, at least one of said opposed surfaces of each of said adjacent teeth being oriented at an angle relative to said axis of rotation so that the space defined between said opposed angularly oriented surfaces of said adjacent teeth is automatically adjusted a predetermined distance during relative linear movement of said opposed grinding members for adjusting said gap spacing of said second grinding zone.

15. A method of refining pulp stock in a continuous grinding space defined between a pair of opposed grinding members relatively rotatable around an axis of rotation, said grinding space including a first inner grinding zone defined between opposed surfaces of a plurality of adjacent teeth extending into said grinding space from said opposed grinding members, said first inner grinding zone merging into a second outer grinding zone oriented at an inclinded angle relative to said first inner grinding zone, and in which said pulp material is introduced into said first grinding zone and is propelled outwardly through said first and second grinding zones by centrifugal forces generated by the relative rotation of said opposed grinding members, the steps of said method comprising:

adjusting the width of said first inner grinding zone while simultaneously adjusting the width of said second outer grinding zone, said step of simultaneously adjusting the widths of said first inner and said second outer grinding zones including the step of selecting the configuration and orientation of said plurality of teeth such that the spacing between said opposed surfaces of said plurality of adjacent teeth is adjusted a predetermined distance during relative linear movement of said opposed grinding members for adjusting the width of said second grinding zone.

16. The method of claim 15 including the step of mounting said teeth to said opposed grinding members in concentric rows, and radially offsetting said concentric rows of teeth extending from one grinding member from the concentric rows of teeth extending from said opposed grinding member to define said plurality of spaces between the opposed surfaces of teeth in adjacent rows.

17. The method as claimed in claim 16 including the step of providing retarding means on each of said concentric rows of teeth extending from said opposed grinding members for preventing said pulp stock from bypassing said spaces defined between said opposed surfaces of adjacent teeth.

18. The method of claim 15 further including the step of orienting at least one of said opposed surfaces of said plurality of teeth at a predetermined angle relative to said axis of rotation, and arranging said teeth such that said spaces defined between the angularly oriented opposed surfaces of adjacent teeth are oriented at said predetermined angle relative to said axis of rotation.

19. The method of claim 18 wherein said predetermined angle is equivalent to said orientation of said second grinding zone relative to said first grinding zone.

20. The method as claimed in claim 15 further including the step of orienting and arranging at least one surface of each of said plurality of teeth such that at least some of said spaces defined between said opposed surfaces of adjacent teeth remain constant and unchanged during said adjustment of said outer grinding zone.

* * * * *